United States Patent [19]

Bitter, Jr. et al.

[11] 4,053,896

[45] Oct. 11, 1977

[54] SELF-ERECTING, HEMISPHERICALLY DIRECTIONAL BUOY ANTENNA

[75] Inventors: Charles Raymond Bitter, Jr.; Robert Bruce Malcolm, both of Scottsdale, Ariz.

[73] Assignee: Motorola, Inc., Schaumburg, Ill.

[21] Appl. No.: 666,853

[22] Filed: Mar. 15, 1976

[51] Int. Cl.[2] ..... H01Q 1/34

[52] U.S. Cl. ..... 343/709; 343/898

[58] Field of Search ..... 343/705, 707, 708, 709, 343/710, 742, 898, 18 R

[56] References Cited

U.S. PATENT DOCUMENTS

| | | | |
|---|---|---|---|
| 3,248,689 | 4/1966 | Shomphe et al. | 343/709 |
| 3,500,408 | 3/1970 | Daughenbaugh | 343/18 B |
| 3,568,191 | 3/1971 | Hiester | 343/18 B |

*Primary Examiner*—Eli Lieberman

*Attorney, Agent, or Firm*—Eugene A. Parsons

[57] ABSTRACT

A buoyant body having one end of a plurality of elongated electrically conductive spring members affixed thereto with the other end of the spring members attached to a movable member, which is in turn affixed to the body and movable with relation thereto, said movable member being held in a first or stored position and biased by the spring members to a second or erected position wherein the spring members define spaced apart arcuate portions of a sphere and are connected as elements of the antenna.

7 Claims, 4 Drawing Figures

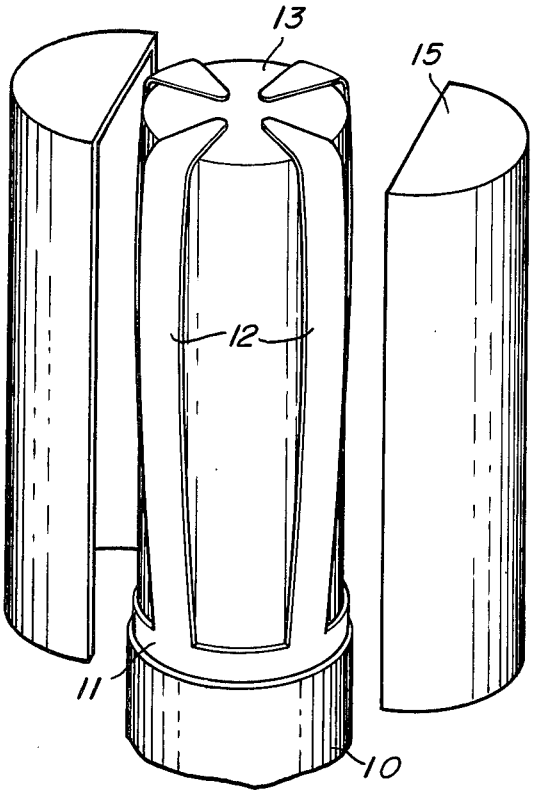
Fig. 1
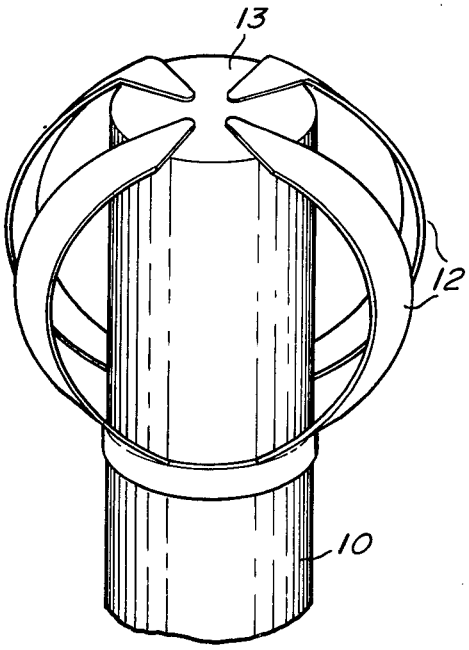
Fig. 2
Fig. 3
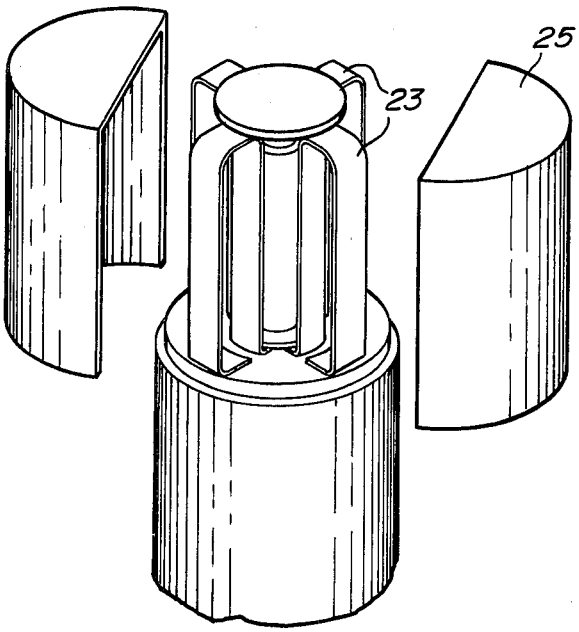
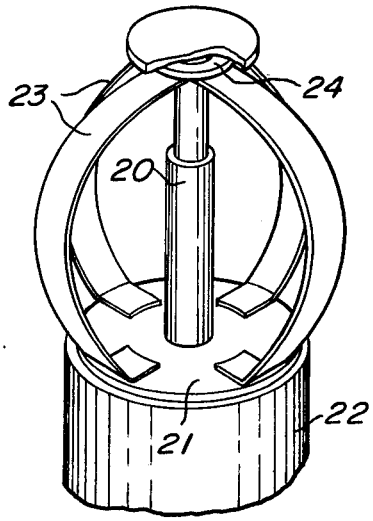
Fig. 4

SELF-ERECTING, HEMISPHERICALLY DIRECTIONAL BUOY ANTENNA

BACKGROUND OF THE INVENTION

1. Field of the Invention

Self-erecting buoy antennas of the type described in the present application are generally useful for communication buoys and emergency equipment in conjunction with submarines and the like. In one specific use for a buoy antenna, the body of the buoy contains batteries and a miniature transmitter with some form of antenna connected thereto. The buoy is releasable from, for example, a submerged submarine which may be in distress. Upon release, the buoy floats to the surface, the antenna is erected and the transmitter is activated. Since buoys of this type are generally used in conjunction with emergencies, it is essential that the system be simple and reliable.

2. Description of the Prior Art

The prior art buoy antenna systems use quarterwave whip antennas erectable by means of explosive charges, helical springs and the like, which are relatively complicated and, therefore, unreliable. The whip antenna does not provide good radiation coverage at the zenith, which is a defininte handicap when communicating with satellites, overhead aircraft, etc. Therefore, it is desirable to supply the buoy with an antenna having substantially hemispherical radiation coverage and with an antenna which is reliable, light weight and rugged.

SUMMARY OF THE INVENTION

The present invention pertains to a self-erecting, hemispherically directional buoy antenna including a buoyant body with movable means affixed thereto for movement from a stored to an erected position, a plurality of elongated, electrically conductive spring members each connected at one end to the body and at the other end to the movable means so as to be generally equally spaced about a central axis and to bias the movable means toward the erected position, releasable means normally holding the movable means in the stored position and releasable to allow the movable means to move to the erected position and means connecting a radio within the buoy to the spring members to provide generally hemispherical radiation therefrom.

It is an object of the present invention to provide a self-erecting, hemispherically directional buoy antenna.

It is a further object of the present invention to provide a self-erecting, hemispherically directional buoy antenna wherein plurality of elongated, electrically conductive spring members provide the erecting force and also define spaced apart arcuate portions of a sphere in the erected position, which arcuate portions operate as the elements of the antenna to provide generally hemispherical radiation.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the figures:

FIG. 1 is a view in perspective, with portions thereof exploded, illustrating an embodiment of the present invention with the antenna in the stored position;

FIG. 2 is a view in perspective of the apparatus illustrated in FIG. 1, with the antenna in the erected position;

FIG. 3 is a view similar to FIG. 1 of another embodiment of the present invention; and FIG. 4 is a view in perspective of the apparatus illustrated in FIG. 3, with the antenna in the erected position.

DESCRIPTION OF THE PREFERRED EMBODIMENT

Referring specifically to FIGS. 1 and 2, a buoyant body 10 is illustrated as having an elongated, generally cylindrical shape. A ring 11 is coaxially affixed around the body 10 for sliding movements therealong. Four elongated spring members 12 each have one end affixed to the ring 11 and the other end affixed to one end 13 of the body 10. The spring members 12 are preformed into the shape illustrated in FIG. 2, which is the erected position, and may be forced inwardly against the body 10 to assume the position illustrated in FIG. 1, which is the stored position. The spring members 12 and the ring 11 are maintaned in the stored position by a two-piece releasable housing 15 which is designed to form a cup-like cap over the end of the body 10 containing the hemispherically directional antenna. The housing 15 may be held together in sealing engagement over the body 10 by means of a burn wire, water soluable material, etc. and releases upon the proper actuation, as for example when the buoy is discharged into water or when an electrical current is applied to the burn wire. When the material holding the portions of the housing 15 together is released, the spring members 12 force the housing 15 away from the body 10 and move, with the ring 11, into the erected position illustrated in FIG. 2.

In the erected position of FIG. 2, the spring members 12 form quarterwave length semi-loop antenna elements which are, for example, fed at the end 13 of the body 10 by connections to a transmitter located within the body 10. The spring members 12, in the present embodiment, are quadrature excited to provide an omni-directional, hemispheric radiation pattern. Because of the hemispheric radiation pattern, the present antenna provides better coverage at the zenith than other prior art antennas. Further, the spring members 12 provide the bias necessary to move the assmebly from the stored to the erected position to greatly simplify the present assembly and increase reliability thereof. It will of course be understood by those skilled in the art that insulating material will be utilized where necessary, such as end 13 of body 10, to provide the proper operation of the antenna.

Referring to FIGS. 3 and 4, a second embodiment of a self-erecting, hemispherically directional buoy antenna is illustrated wherein a telescopically extendable rod 20 is attached at one end of a cylindrically shaped buoyant body 22 so as to extend axially outwardly therefrom generally coaxial with the cylindrical body 22. A plurality (in this embodiment 4) of spring members 23 each have one end affixed to the end 21 of the body 22 and the other ends are affixed to a ring 24 slideable engaged over the rod 20. The spring members 23 are preformed into arcuate portions of a sphere as illustrated in FIG. 4. With the rod 20 in the stored position and the ring 24 adjacent the end 21 of the housing 22, the spring members 23 are folded inwardly so that a releasable housing 25 can be positioned thereover. The housing 25 is generally cupshaped and fits over the antenna assembly in sealing engagement with the end 21 of the housing 22 to maintain the antenna assembly in the stored position. The housing 25 is formed in a plurality of parts which are held together by means of burn wires, water soluable material, etc. which may be released when desired to allow the housing 25 to separate. The preformed spring members 23 separate the portions of the housing 25 when the material holding them together is released and telescope the rod outwardly to assume the position illustrated in FIG. 4. As in the previously explained embodiment, the spring members 23 form quarterwave length antenna elements which may be fed from either end. In this embodiment the spring members 23 are quadrature excited from the end 21 of the body 22 so as to provide a generally hemispheric radiation pattern. Also, as will be understood by those skilled in the art, various portions of the structure must either be formed of insulating material or coated with insulating material to provide the proper antenna operation. In this embodiment, as in the previous embodiment, the spring members 23 provide the bias required for self-erecting the antenna and, because a minimum of components are required, the antenna is very light weight and reliable.

While we have shown and described specific embodiments of this invention, further modifications and improvements will occur to those skilled in the art. We desire it to be understood, therefore, that this invention is not limited to the particular forms shown and we intend in the appended claims to cover all modifications which do not depart from the spirit and scope of this invention.

We claim:

1. A self-erecting, hemispherically directional antenna comprising:

a. a body;

b. movable means affixed to said body and movable with relation thereto from a first to a second position;

c. a plurality of elongated, electrically conductive spring members each connected at one end to said body and at the other end to said movable means, said spring members being generally equally spaced about a central axis;

d. said spring members assuming a stored position with said movable means in the first position and defining spaced apart arcuate portions of a sphere with said movable means in the second position;

e. connecting means electrically coupled to said spring members for coupling radio signals between said spring members and a radio;

f. said movable means being biased toward the second position; and g. releasable means normally positioned to hold said movable means in the first position and releasable to allow said movable means to move to the second position.

2. A self-erecting, hemispherically directional antenna as claimed in claim 1 wherein the body is generally cylindrically shaped with the movable means including a ring coaxially encircling the body and slideable therealong.

3. A self-erecting, hemispherically directional antenna as claimed in claim 2 wherein the spring members each have one end attached to one end of the body and the spring members are preformed into arcuate shapes to bias the movable means toward the second position.

4. A self-erecting, hemispherically directional antenna as claimed in claim 1 wherein the releasable means includes a multi-piece housing surrounding the antenna and at least a portion of the body in fluid-tight engagement.

5. A self-erecting, hemispherically directional antenna as claimed in claim 1 wherein the movable means includes an elongated rod mounted in axially extending relation on the body and telescopically movable from a first stored position to a second extended position.

6. A self-erecting, hemispherically directional antenna as claimed in claim 1 wherein four elongated spring members are utilized.

7. A self-erecting, hemispherically directional buoy antenna comprising:

a. a generally cylindrically shaped buoyant body;

b. an elongated rod mounted on one end of said body so as to extend generally axially outwardly therefrom, said rod being telescopically movable from a stored position to an extended position;

c. a plurality of elongated, electrically conductive spring members each connected at one end to said body at the other end adjacent to the outer end of said rod, said spring members being preformed into arcuate portions of a sphere and being generally equally spaced about said rod;

d. said spring members assuming a stored position with said rod in the stored position and defining spaced apart arcuate portions of a sphere with said rod in the extended position, said spring members biasing said rod toward the extended position;

e. connecting means electrically coupled to said spring members for coupling radio signals between said spring members and a radio; and f. releasable means normally positioned to hold said elongated rod in the stored position and releasable to allow said elongated rod to move to the extended position.

* * * * *